US005333363A

United States Patent [19]

Artusi et al.

[11] Patent Number: 5,333,363

[45] Date of Patent: Aug. 2, 1994

[54] TIGHTENING DEVICE FOR SKI BOOT

[75] Inventors: Giovanni Artusi, Pianiga; Stelio Simonetti, Noale, both of Switzerland

[73] Assignee: Lange International S.A., Fribourg, Switzerland

[21] Appl. No.: 984,906

[22] Filed: Dec. 2, 1992

[30] Foreign Application Priority Data

Jan. 29, 1992 [CH] Switzerland ..... 252/92

[51] Int. Cl.[5] ..... A43C 11/00

[52] U.S. Cl. ..... 24/685 K; 24/705 K

[58] Field of Search ..... 24/685 K, 68 R, 705 K, 24/695 K, 715 K; 36/50.5, 117

[56] References Cited

U.S. PATENT DOCUMENTS 4,253,217 3/1981 Marzocchi .
4,424,636 1/1984 Everest ..... 24/685 K X
4,672,755 6/1987 Benoit ..... 24/685 K X
4,691,454 9/1987 Ottieri ..... 24/685 K X
4,765,069 8/1988 Baggio et al. ..... 24/685 K X
5,197,165 3/1993 Zorzi et al. ..... 24/685 K
5,233,729 8/1993 Marmonier ..... 24/705 K X

FOREIGN PATENT DOCUMENTS

407336A1 6/1990 European Pat. Off. .

OTHER PUBLICATIONS

Form PCT/ISA/201.(a) (PCT Search Report).

*Primary Examiner*—Laurie K. Cranmer
*Attorney, Agent, or Firm*—Kane, Dalsimer, Sullivan, Kurucz, Levy, Eisele & Richard

[57] ABSTRACT

The tightening device comprises a tensioning lever, to which there are connected a first traction member and a second traction member. The device comprises means, such as a boss, exerting a delayed traction on the second traction member at the time of opening of the tensioning lever.

6 Claims, 2 Drawing Sheets

TIGHTENING DEVICE FOR SKI BOOT

FIELD OF THE INVENTION

The present invention relates to a tightening device for a ski boot, acting on two traction members and comprising a tensioning lever articulated on a seat and connected to at least a first traction member.

PRIOR ART

From European Patent Application No 0 407 336, it is known to act simultaneously on two cables by means of a single tightening device so that a simultaneous tightening, and a simultaneous relaxation respectively of the shaft and of the foot is possible by means of a single buckle.

From French Patent Application No 2 661 076, a tightening device is also known which acts simultaneously on a buckle for closing the shaft of the boot and on a cable controlling the locking of the shaft of the boot about its articulation.

In the above application, as well as in the case in which it is desired to have a position of relaxation which is separate from the position of complete loosening or of opening, it would be of interest to be able to act in a non-simultaneous manner on the two traction members.

SUMMARY OF THE INVENTION

The aim of the present invention is precisely to bring about a non-simultaneous action on the two traction members controlled by the tightening device.

The tightening device according to the invention is characterized in that it comprises means which bring about a delayed action of the tensioning lever on the second traction member at the time of opening of the tensioning lever.

The action on the second traction member can be either simply delayed relative to the action on the first traction member but brought about in an automatic manner at the time of opening of the tensioning lever, or independent of the opening of the tensioning lever, that is to say necessitating a particular action on the tensioning lever after its opening.

The complete separation of the actions on the two traction members is particularly useful when the tightening device is used at the same time for releasing the tightening of the shaft of a boot and bringing about its opening by the unlocking of a closing device.

BRIEF DESCRIPTION OF THE DRAWINGS

The attached drawing represents, by way of example, two embodiments of the invention.

DESCRIPTION OF THE PREFERRED EMBODIMENT(S)

Figure 1:
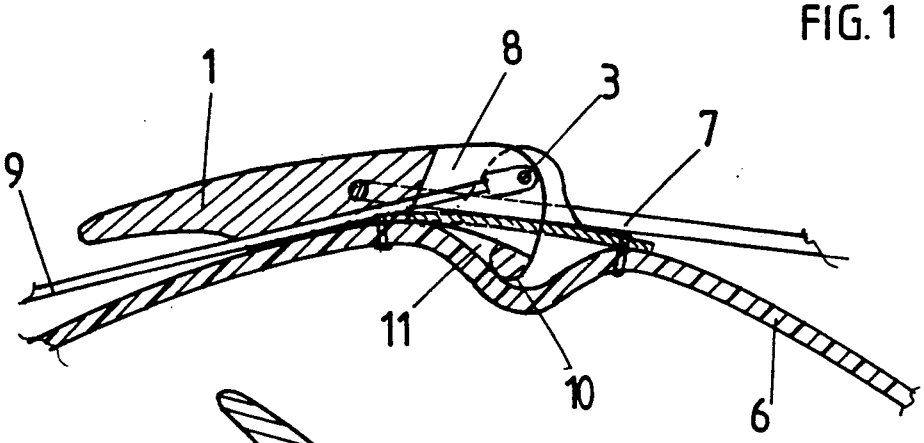
FIG. 1 is a view in longitudinal cross-section of a tightening device according to a first embodiment, in closed position.
Figure 2:
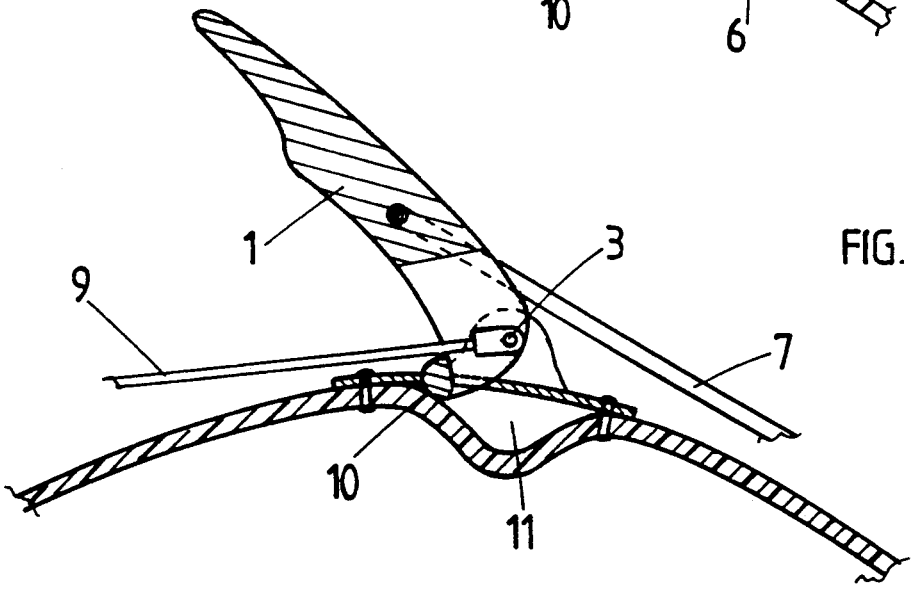
FIG. 2 represents the same device in the course of opening.
Figure 3:
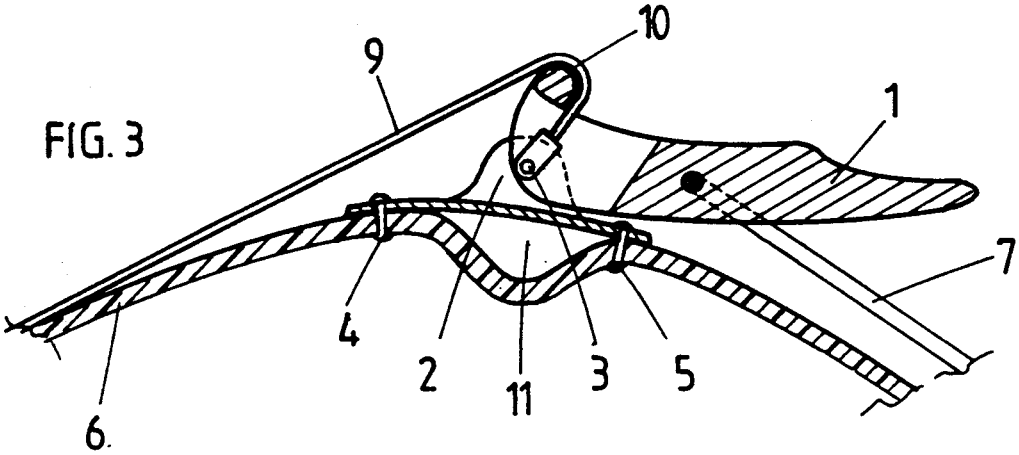
FIG. 3 represents the same device completely open.

The tightening device represented in FIGS. 1 to 3 comprise a tensioning lever 1 articulated on a seat 2 in the form of a stirrup about a pin 3. The seat 2 is fixed by means of rivets 4 and 5 on a part of the boot 6, for example a shaft. Articulated on the tensioning lever 1, approximately halfway between its articulation pin 3 and its end, is a rectangular buckle 7 which constitutes a first traction member. The tensioning lever 1 has a rectangular cutout 8, in which the end of a cable 9 is attached about the pin 3. The tensioning lever 1 also has a short elbowed arm forming a rounded boss 10 which cones to be housed in a depression 11 of the boot in the closed position of the tensioning lever, as represented in FIG. 1.

At the time of opening of the tensioning lever 1, the traction buckle 7 is released progressively, as represented in FIG. 2. At the time of this opening, no traction is exerted on the cable 9 since the latter is attached to the articulation pin 3 of the tensioning lever.

At the end of a given angle of rotation of the tensioning lever 1, the boss comes to abut against the cable 9 which is then wound around the boss 10 as shown in FIG. 3. A delayed action is then exerted on the cable 9.

The attachment point of the cable 9 on the tensioning lever 1 could be separate from the pin 3 but close to the latter so that the tension on the cable 9 contributes to keeping the tensioning lever 1 in the closed position without, however, the rotation of the tensioning lever modifying in an appreciable manner the tension on the cable 9 before the latter meets the boss 10.

In the device represented in FIGS. 1 to 3, the action on the cable 9 takes place automatically at the time of opening of the tensioning lever 1, after a given rotation of this tensioning lever. It would, however, be possible to give the boss 10 a position and a shape such that the tensioning lever does not act automatically on the cable 9 at the time of its opening, but so that it is necessary to exert a pressure on the open tensioning lever to make this tensioning lever pivot beyond its open and stable position which is determined by the tension subsisting on the buckle 7 or, in the absence of such a traction, the tension on the cable 9, so as to pull on the cable 9 in the same manner as shown in FIG. 3. Such an action, which is not only delayed but also autonomous on the cable 9, is necessary if it is desired to use the tensioning lever to bring about successively a relaxation of the clamping of the shaft of the boot and an opening of this shaft.

Figure 5:
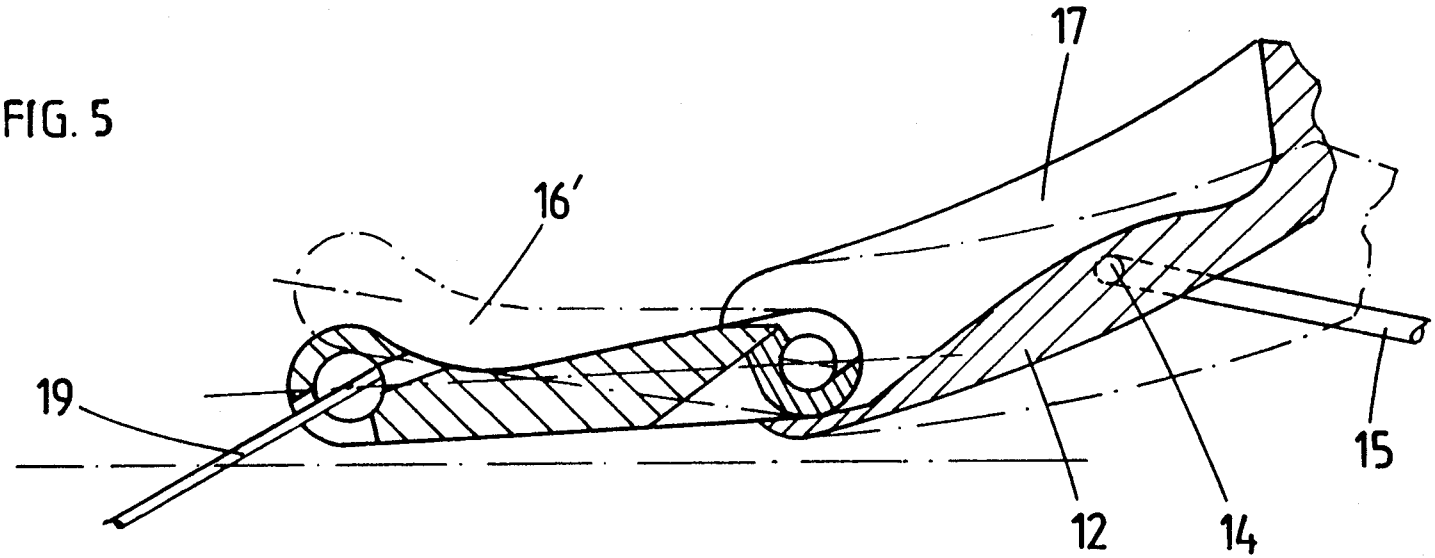
FIG. 5 represents the device in FIG. 4 in open position.
Figure 4:
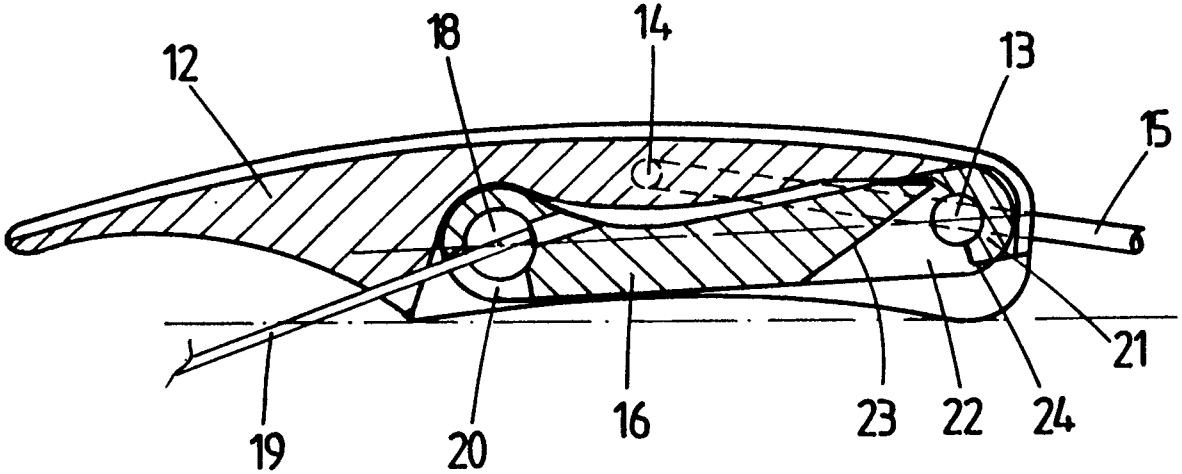
FIG. 4 is a view in longitudinal cross-section of a second embodiment, in closed position.

A second embodiment is represented in FIGS. 4 and 5. The tightening device comprises a principal lever articulated on a seat (not shown) about a pin 13. Articulated in an intermediate point 14 of the tensioning lever 12 is a buckle 15 which constitutes a first traction member. Articulated about the pin 13 is a second lever 16 which comes to be housed in a housing 17 of the lever 12 in the closed position of the latter. The other end of the lever 16 has a circular hole with an axis parallel to the pin 13, in which hole there is mounted a cylindrical stud 18, in which there is fixed a cable 19 which passes through the end of the lever 16 via a slot 20, the cable 19 constituting a second traction member.

Close to its articulation pin 13, the principal lever 12 has a part 21 in the form of a cam engaged in a slot 22 of the second lever 16, the bottom of which slot is constituted by an inclined plane 23.

At the time of opening of the tensioning lever 12, it part 21 in the form of a cam carries out a rotation of approximately 160° in the slot 22 of the second lever 16 before encountering, via a stop face 24, the inclined plane 23 of the lever 16. A subsequent rotation of the tensioning lever 12 has the effect of driving the second lever 16, as represented at 16' in FIG. 5, and consequently of exerting a traction on the cable 19. This subsequent rotation can be brought about either by the end of the movement of the opening of the tensioning lever 12 or by a pressure on this tensioning lever 12 so as to make it pivot beyond its stable opening position.

We claim:

1. A tightening device for a ski boot, acting on first and second traction members (7, 9; 15, 19) and comprising a tensioning lever (1; 12) having a time of opening and being articulated on a seat and connected to at least said firsts traction member (7; 15), which comprises means (10; 16) which bring about a delayed tensioning action of the tensioning lever on the second traction member (9; 19) from the time of opening of the tensioning lever.

2. The device as claimed in claim 1, wherein the second traction member has an articulation pin and is a cable (9) attached to the tensioning lever at a point which is close to its articulation pin (3) or coincides with this pin and wherein the means bringing about a delayed action of the tensioning lever are constituted by a boss (10) of the tensioning lever, on which the cable is wound starting from a predetermined angle of opening of the tensioning lever.

3. The device as claimed in claim 2, wherein the second traction member is actuated after the complete opening of the tensioning lever, by pressure on the tensioning lever.

4. The device as claimed in claim 1, wherein the tensioning lever (12) has an articulated pin (13), which device comprises a second lever (16) which is articulated about the articulated pin of the tensioning lever (12) and to which the second traction member (19) is attached, this second lever being actuated by the tensioning lever after a given rotation of the latter.

5. The device as claimed in claim 3, wherein the tensioning lever (12) has a part in the form of a cam (21) which interacts with a stop surface (23) of the second lever after a given rotation of the tensioning lever (12).

6. The device as claimed in claim 3, wherein the second traction member is actuated after the complete opening of the tensioning lever, by pressure on the tensioning lever.

* * * * *

UNITED STATES PATENT AND TRADEMARK OFFICE

CERTIFICATE OF CORRECTION

PATENT NO. : 5,333,363

DATED : August 2, 1994

INVENTOR(S) : Giovanni Artusi and Stelio Simonetti

It is certified that error appears in the above-identified patent and that said Letters Patent is hereby corrected as shown below:

On the title page:
Inventors: should read

--Giovanni Artusi, Pianiga; Stelio Simonetti, Noale both of Italy--

Signed and Sealed this

Twenty-fifth Day of October, 1994

*Attest:*

*Attesting Officer*

BRUCE LEHMAN

*Commissioner of Patents and Trademarks*